United States Patent [19]

Ball et al.

[11] Patent Number: 4,587,658

[45] Date of Patent: May 6, 1986

[54] APPARATUS FOR SEALING ELECTRODES IN ELECTRIC ARC FURNACES

[75] Inventors: Kevin D. Ball, Grimsby, Canada; Peter Davies, North Anston, England

[73] Assignee: Coated Electrodes Limited, Sheffield, England

[21] Appl. No.: 676,883

[22] Filed: Nov. 30, 1984

Related U.S. Application Data

[63] Continuation of Ser. No. 443,852, Nov. 22, 1982, Pat. No. 4,517,678.

[30] Foreign Application Priority Data

| | | | |
|---|---|---|---|
| Nov. 20, 1981 | [GB] | United Kingdom | 8135012 |
| Jul. 30, 1982 | [GB] | United Kingdom | 8222022 |
| Aug. 11, 1982 | [GB] | United Kingdom | 8223179 |

[51] Int. Cl.[4] ..... H05B 7/12

[52] U.S. Cl. ..... 373/95; 373/96

[58] Field of Search ..... 373/94, 95, 96, 100, 373/101

[56] References Cited

U.S. PATENT DOCUMENTS

| | | | |
|---|---|---|---|
| 2,761,003 | 8/1956 | Richardson | 373/95 X |
| 3,379,816 | 4/1968 | Hozven | 373/95 |
| 3,621,104 | 11/1971 | Valchev et al. | 373/95 |

FOREIGN PATENT DOCUMENTS

| | | | |
|---|---|---|---|
| 1167992 | 4/1964 | Fed. Rep. of Germany | 373/95 |
| 46901 | 1/1969 | United Kingdom | 373/95 |
| 232294 | 6/1969 | U.S.S.R. | 373/95 |

*Primary Examiner*—Roy N. Envall, Jr.

*Attorney, Agent, or Firm*—Bacon & Thomas

[57] ABSTRACT

Apparatus for sealing an electrode in an electric arc furnace comprises an annular chamber which is adapted to encompass the electrode and includes a ring-shaped cover member of a refractory material which is supported above or is formed integrally with an upstanding cylindrical wall member. The wall member has a passageway which is inclined with respect to the radius of the chamber and is connected to receive gas under pressure and to discharge such gas on to and around the encompassed electrode effectively to seal the space around the electrode.

3 Claims, 7 Drawing Figures

APPARATUS FOR SEALING ELECTRODES IN ELECTRIC ARC FURNACES

This application is a continuation of application Ser. No. 443,852 filed Nov. 22, 1982 now U.S. Pat. No. 4,517,678 issued May 14, 1985.

This invention refers to apparatus for sealing electrodes in electric arc furnaces.

At the present time various sealing devices for electrode appertures are used in electric arc furnaces. One such device comprises a steel chamber which encompasses the electrode and is spaced from the electrode to accommodate movement of the electrode. Because of the need for high quality fabrication and welding, the manufacturing cost of such devices is high. Furthermore it has been found that the use of such devices is disadvantageous in that the necessary regular inspections and cleaning of the device interior is often neglected and in that arcing can occur between the electrode and the device thereby leading to damage to the device.

According to the present invention in one aspect there is provided apparatus for sealing an electrode in an electric arc furnace, the apparatus comprising an annular chamber adapted to encompass the electrode and including a ring-shaped cover member of a refractory material above an upstanding cylindrical wall member formed with at least one passageway which is inclined with respect to the radius of the chamber and is connected to receive gas under pressure and to discharge such gas on to and around the encompassed electrode effectively to seal the space around the electrode.

The upstanding wall member is preferably manufactured from a refractory material and may be formed integrally with the refractory cover member. Alternatively, the cover member may be separable from the wall member. In this latter case, the wall member may be constructed from a refractory material or another suitable material e.g. steel. Furthermore, the lower surface of the ring-shaped cover member may be inwardly inclined to assist correct location of the cover member upon the cylindrical wall member and to direct the gas towards the electrode surface.

In one preferred arrangement, a conduit connected to a source of gas under pressure protrudes partially into the end of the passageway; the end of the conduit remote from the annular chamber may be flared. The chamber may be entirely open on its radially inner periphery.

The refractory ring-shaped cover member may be produced by moulding, cold pressing and firing a refractory material. The cover member preferably comprises of a plurality of segments which, when assembled, define the required ring-shaping.

In arrangements in which the annular chamber comprises integral cover and wall members of refractory material, the annular chamber may be produced by moulding, cold pressing and firing a suitable refractory material. Further, the annular chamber in such arrangements preferably comprises a plurality of segments which when assembled define the required annular shaping. A metal band may be located about the periphery of the assembled separate segments to provide support therefore. In this arrangement, the conduit connected to a source of gas under pressure may be mounted within or be secured to the encompassing band.

In one segmented arrangement, the abutting sides of moulded segments have complementary shapes to assist assembly and give stability to the cover member or annular member on assembly.

According to the present invention in another aspect there is provided apparatus for sealing the space between an electrode and an aperture formed in one wall of an electric arc furnace, the apparatus comprising an assembly of a plurality of cooperating segments which together define an annular chamber of a refractory material which encompasses the electrode and includes an upper ring-shaped member and a peripheral wall dependent from the radially outer boundary of the upper member, the peripheral wall being formed with at least one passageway which is inclined with respect to the radius of the chamber and is connected to receive gas under pressure from an inlet conduit and to discharge such gas on to and around the encompassed electrode effectively to seal the space between the electrode and the arc furnace wall. Preferably, the annular chamber comprises a plurality of segments which on assembly define the required annular shaping.

The invention will now be described by way of example with reference to the accompanying diagrammatic drawings in which.

Figure 1:
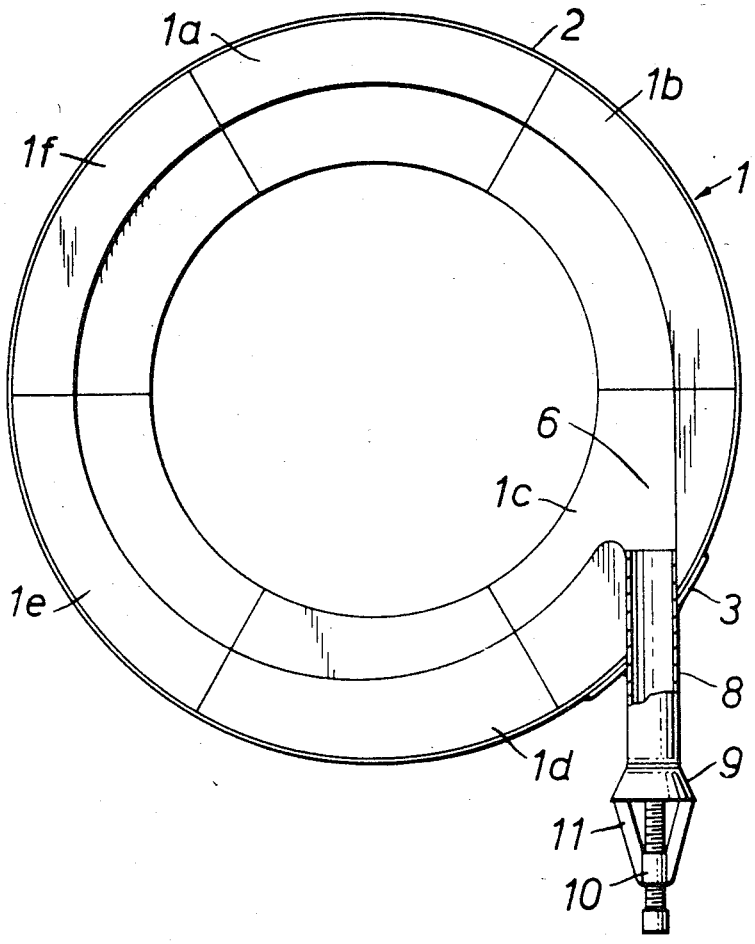
FIG. 1 is a plan view from below of sealing apparatus in accordance with the invention.
Figure 2:
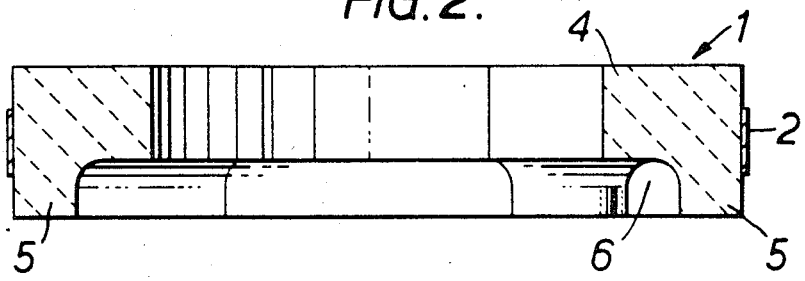
FIG. 2 is a side elevation in section of the apparatus shown in FIG. 1.
Figure 3:
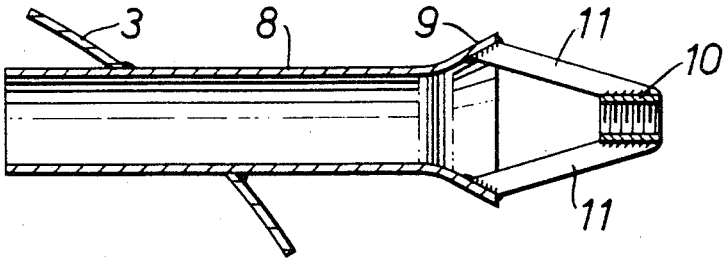
FIG. 3 is a plan view in section of a conduit for use with the apparatus illustrated in FIGS. 1 and 2.

The sealing device illustrated in FIGS. 1 to 3 of the drawings comprises an annular chamber 1 comprising a plurality of segments 1*a* . . . 1*f* held together by peripheral mild steel banding 2. Each segment 1*a* . . . 1*f* is constructed by moulding a refractory material and then subjecting the moulded material to dry pressing and firing.

A typical refractory comprises by weight percent 40.15% Alumina, 54.90% silica, 1.30% Iron, 2.00% Titania, 0.35% Lime, 0.20% Magnesia and 1.10% Alkalies.

On assembly of the segments, the chamber includes an upper ring-shaped cover 4 and a peripheral wall 5 which depends below the radially outer boundary of the cover 4. A passageway 6 is formed in the wall 5 of the chamber and is inclined at an acute angle to the radius of the chamber. As will be seen more clearly from FIG. 2 the chamber is of inverted "L" shape in cross section, its radially inner side being entirely open. In use, the chamber is seated on a brick support located on the roof of an arc furnace about the electrode aperture.

A mild steel conduit 8 partially protrudes into the passageway 6 and is retained in position through a steel plate 3 secured to the mild steel banding 2. As will be seen from FIGS. 1 and 3 the conduit has a flared end 9 within which a pipe nipple 10 is supported by spacer 11.

The nipple is connectable to a source of gas under pressure through a suitably threaded pipeline.

Figure 4:
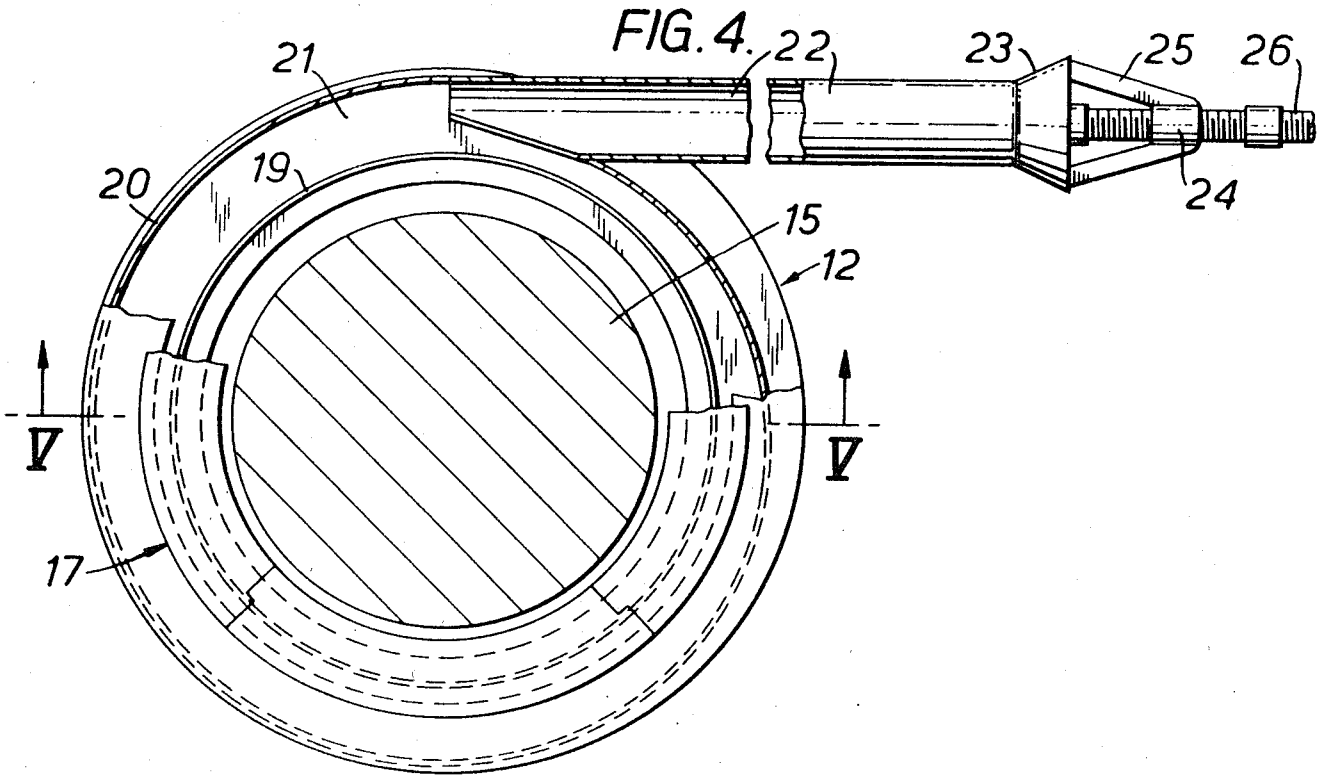
FIG. 4 is a plan view from above partly in section of further sealing apparatus in accordance with the invention.

Turning now to sealing device illustrated in FIGS. 4 to 7 of the drawings, the device again includes an annular chamber 12 which is supported by bricks 13 above the roof 14 of an electric arc furnace to encompass a furnace electrode 15. The chamber comprises an upstanding cylindrical wall member 16 and a separable ring-shaped cover 17 of refractory material which seats upon an upper rim of the wall member 16. As can be seen in FIG. 4, the inner diameter of cover 17 is greater than the diameter of electrode 15. The wall member 16 which may be constructed of a refractory material or may, for example, be manufactured from steel, includes a base 18 which carries radially inner and outer walls 19,20 which together define a passageway 21 for air under pressure admitted through a conduit 22 similar to conduit 8 of FIGS. 1 and 3. The conduit 22 has a flared end 23 within which a pipe nipple 24 is supported by spacer 25. The nipple is connected by pipe line 26 to a source of gas under pressure.

Figure 6:
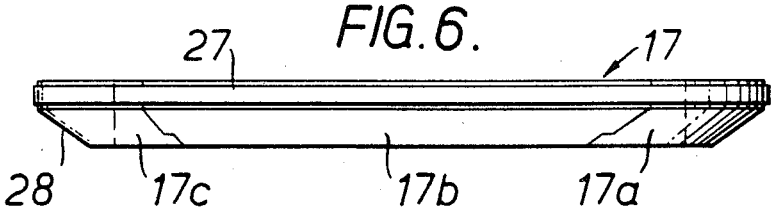
FIGS. 6 and 7 are respectively side elevational and plan views of a ring shaped cover member forming part of the apparatus illustrated in FIGS. 4 and 5.
Figure 7:
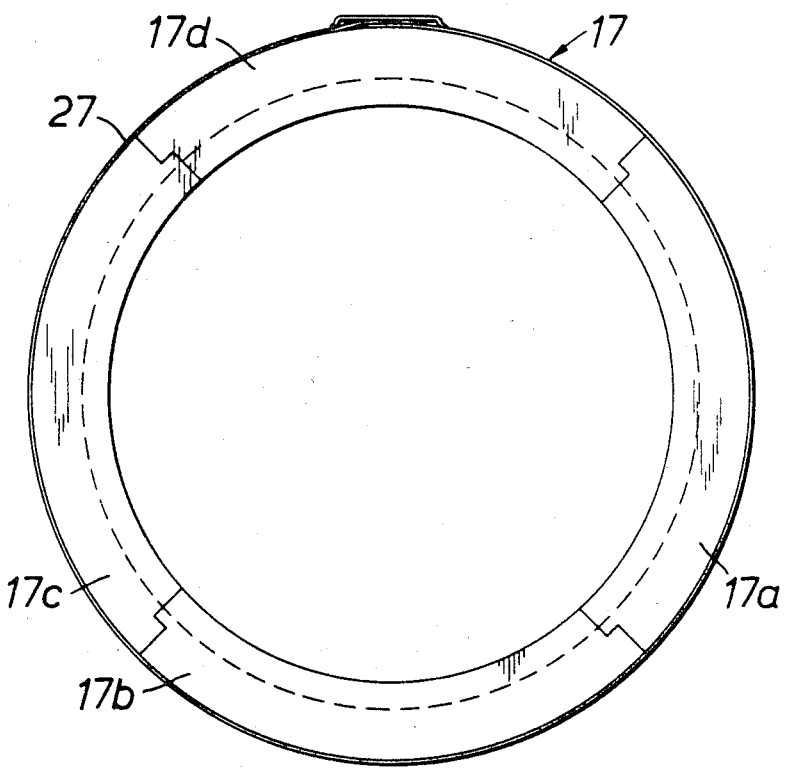

The ring-shaped cover member 17 is illustrated in greater detail in FIGS. 6 and 7 and comprises four segments 18*a* . . . *d* each constructed of a refractory material and produced by moulding, dry pressing and firing. The opposite ends of the segments 17*a* . . . *d* are shaped so that on assembly the segments are mutually supportive in both vertical and horizontal senses. On assembly the segments may be further supported by a mild steel band 27 extending about the periphery of the member 17.

The under surface 28 of the member 17 slopes inwardly and downwardly to assist centering of the member upon the cylindrical wall member 16 and to direct incoming gas unto the surface of the encompassed electrode.

In use of the sealing devices described above, high velocity gas under pressure is injected into the conduit 8 or 22 and induces a secondary flow of air from the atmosphere into the flared end 9 or 23 of the conduit, the total flow through the conduit entering the chamber through the passageway 6 or 21. The air is directed substantially tangentially into the chamber and flows around the chamber, initially in a spiral sense to provide a seal between the electrode and the adjacent wall of the arc furnace.

One advantage of sealing devices as described above is the ability merely to replace the relatively low cost refractory chamber or cover should it become worn through contact or because of its close proximity to the graphite electrode. Such replacements can be affected both cheaply and quickly without, in the arrangement illustrated in FIGS. 4 to 7, the need to remove the support structure of the sealing device from its location on the arc furnace roof. In addition the refractory composition of the annular chamber or cover member avoids any possibility of arcing between the electrode and the important metal surfaces of the sealing device.

Figure 5:
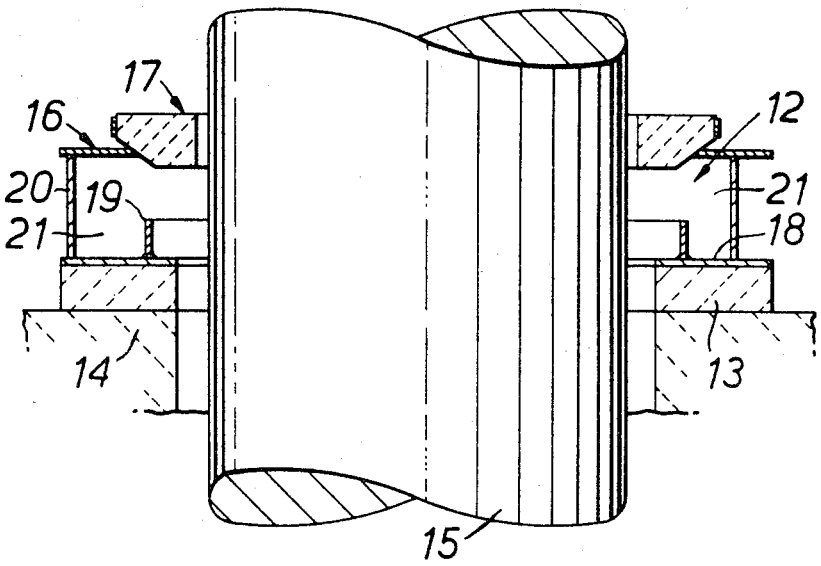
FIG. 5 is a section taken along line IV—IV of FIG. 4.

Whilst the annular chamber 1 illustrated in FIGS. 1 to 4 and the cover member 18 illustrated in FIGS. 5 to 7 are of segmented construction, it is to be understood that each may alternatively be unitary in structure.

For use with a furnace having more than one electrode, several sealing devices would be employed, each such sealing device encompassing one electrode.

We claim:

1. Apparatus for sealing the space between an electrode and an aperture formed in the roof of an electric arc furnace, the apparatus comprising an annular chamber constructed of an electrically non-conductive refractory material consisting essentially of alumina and silica, the annular chamber comprising an upstanding cylindrical wall member which supports an integral ring shaped cover member and having at least one passageway inclined with respect to the radius of the chamber and connected to receive gas under pressure and to discharge such gas onto and around an electrode encompassed by the annular chamber, the internal diameter of the ring-shaped cover member being greater than the diameter of the encompassed electrode to define an annular spacing therebetween through which the gas discharged from said at least one passageway passes effectively to seal the space around the electrode.

2. Apparatus as claimed in claim 1 in which a conduit connected to a source of gas under pressure protrudes partially in the end of the inclined passageway.

3. Apparatus for sealing the space between an electrode and an aperture formed in one wall of an electric arc furnace, the apparatus comprising an assembly of a plurality of co-operating segments which are constructed an electrically non-conductive refractory material consisting essentially of alumina and silica and which together define an annular chamber which encompasses but is spaced from the electrode and includes an upper ring-shaped member and a peripheral wall dependent from the radially outer boundary of the upper member, the peripheral wall being formed with at least one passageway which is inclined with respect to the radius of the chamber and is connected to receive gas under pressure from an inlet conduit and to discharge such gas onto and around the encompassed electrode effectively to seal the space between the electrode and the arc furnace wall.

* * * * *